US005590825A

United States Patent [19]

Murdock

[11] Patent Number: 5,590,825

[45] Date of Patent: Jan. 7, 1997

[54] BACKPACK WITH CONVERTIBLE FRAME

[76] Inventor: Douglas C. Murdock, 2648 Paden Pl., Birmingham, Ala. 35226

[21] Appl. No.: 503,441

[22] Filed: Jul. 17, 1995

[51] Int. Cl.[6] ..... A45F 4/06; A45F 4/08

[52] U.S. Cl. ..... 224/156; 224/153; 224/633; 224/634; 224/645; 5/110; 5/111; 5/114

[58] Field of Search ..... 224/156, 153, 224/155, 628, 634, 210, 211, 633, 645; 135/149; 5/504.1, 178, 179, 197, 6, 114, 112, 111, 110, 493

[56] References Cited

U.S. PATENT DOCUMENTS

| | | | |
|---|---|---|---|
| 105,885 | 8/1870 | Baker | 5/114 |
| 909,620 | 1/1909 | Lamb | 5/114 |
| 4,234,005 | 11/1980 | Taylor, III | 224/156 |

*Primary Examiner*—Henry J. Recla
*Assistant Examiner*—Kam Shah
*Attorney, Agent, or Firm*—Douglas C. Murdock

[57] ABSTRACT

Disclosed is a lightweight backpack and its frame. The design of the frame accommodates use as a structure for shaping and supporting a recreational hiking or military infantry backpack while in a folded and compact arrangement, and additionally, accommodates use for shaping and supporting material for use as a sleeping cot able to support the body weight of a human while in and unfolded elongated arrangement. In either the folded or unfolded arrangement, the backpack may be easily removed or reattached to the frame. The cot material is also easily detachable for purposes of replacement of worn material and its arrangement in conjunction with the frame is also intended to serve in part as padding and back support for the wearer. The hinge and lock at the frame's hinge joints aids the user in fold out and break down of the frame and also adds strength to the frame while in both the folded and unfolded position. The frame includes first, second, and third rigid support structural members pivotally connected end to end with one another. Each structural support member has first and second spaced side supports. The side supports provide for attachment of a sleeping platform material and hinge assemblies for interconnection of the structural support members. The first and third structural members also have vertical sleeping platform supports and interconnecting cross support members depending from either the vertical sleeping platform supports or the side supports.

4 Claims, 12 Drawing Sheets

FIG. 3
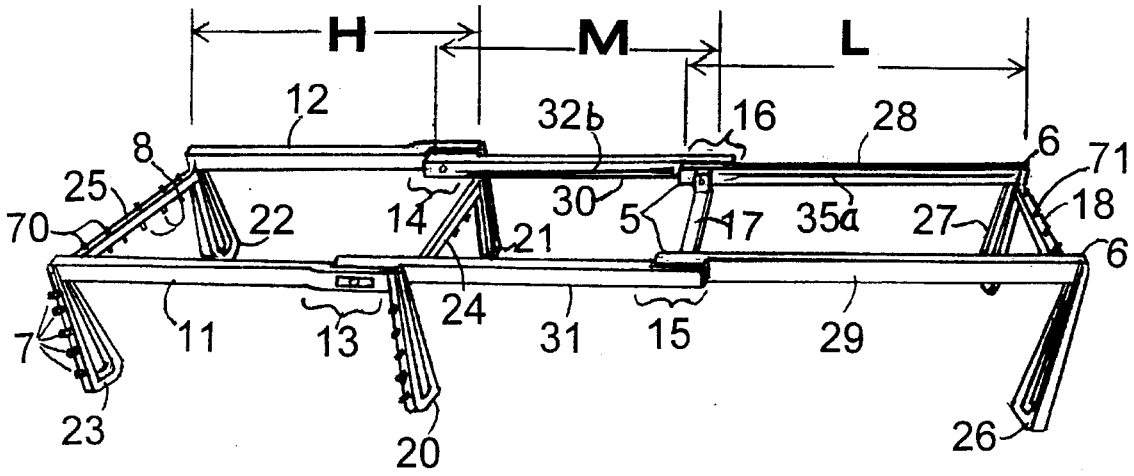
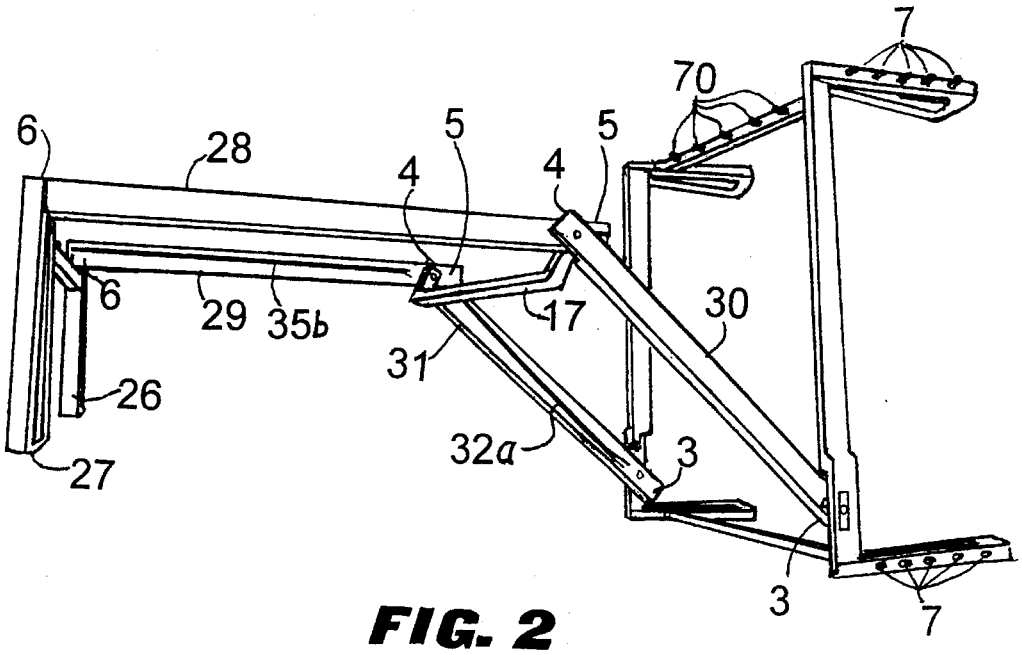
FIG. 2

FIG. 6
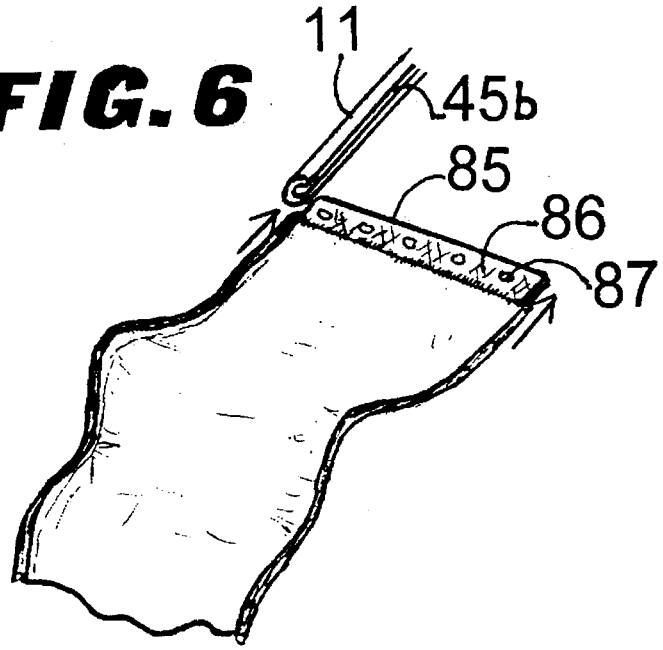
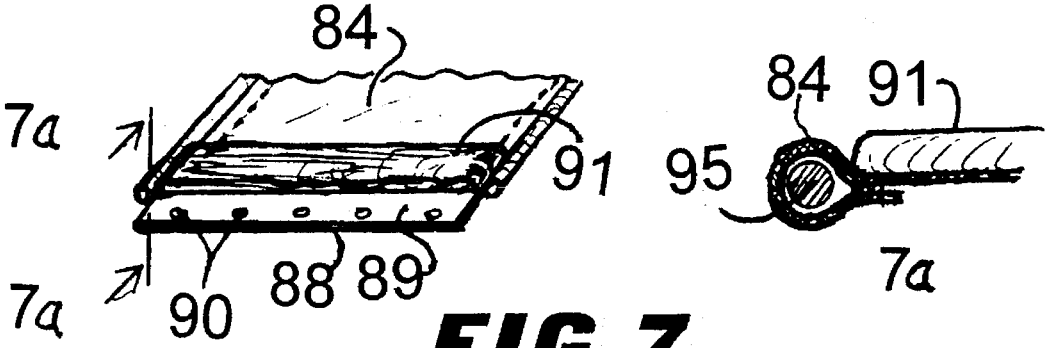
FIG. 7

FIG. 8
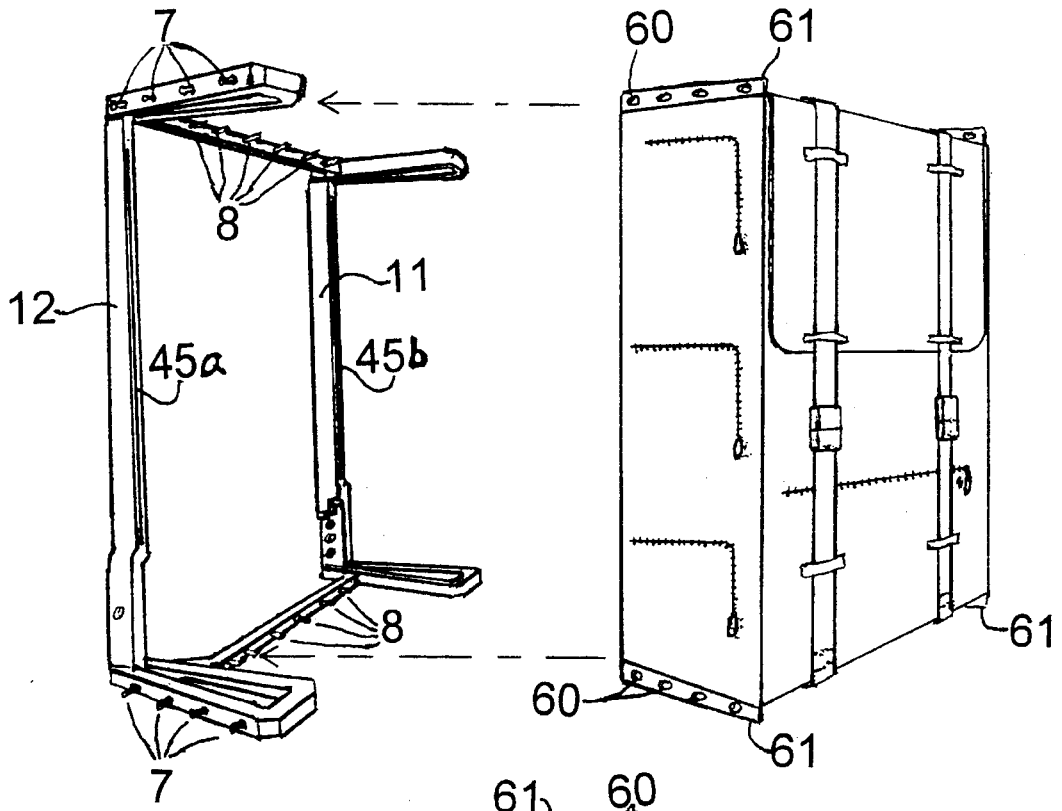
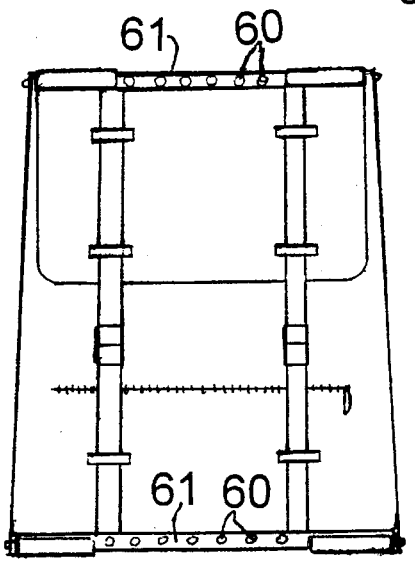
FIG. 8a

FIG. 10
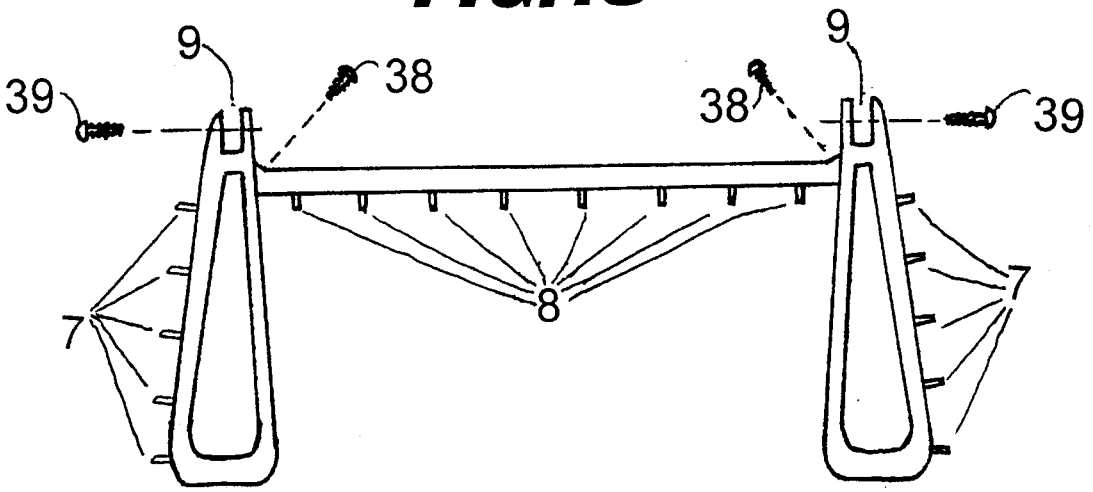
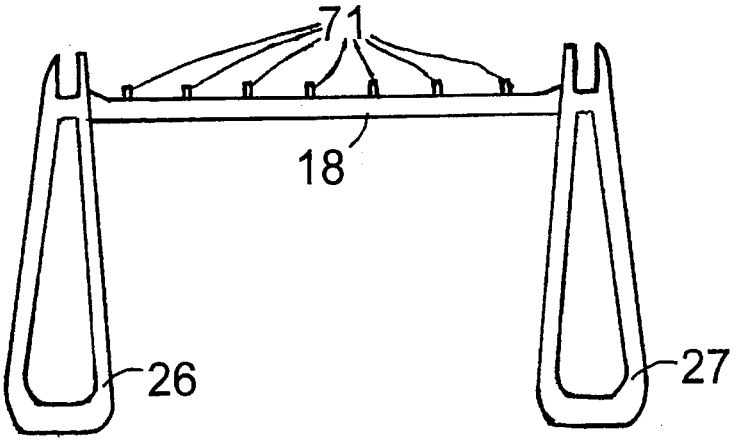
FIG. 10a

FIG. 14
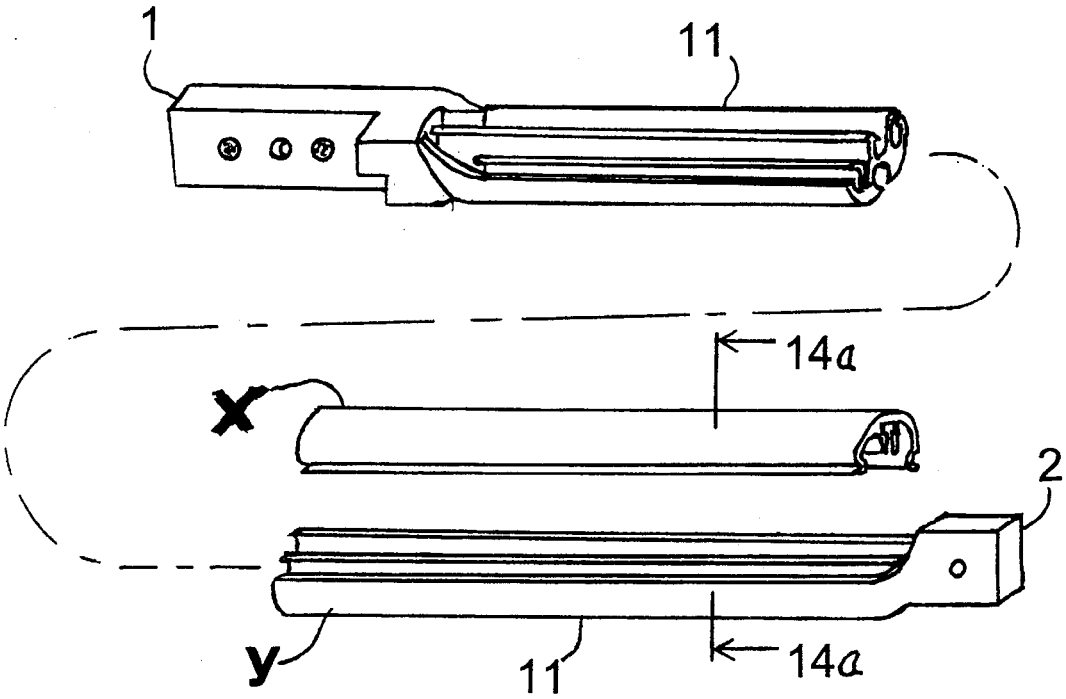
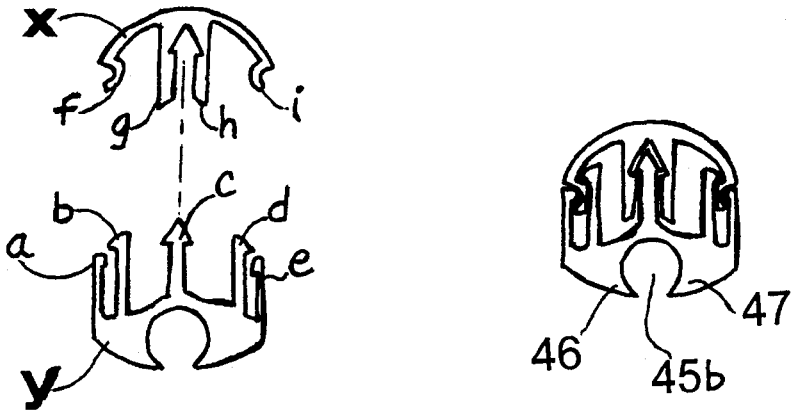
FIG. 14a

BACKPACK WITH CONVERTIBLE FRAME

FIELD OF THE INVENTION

The present invention relates generally to frame supported backpacks used by recreational hikers and military infantry. More particularly, the invention concerns specialized pack frame arrangements and improved frame components enabling a frame for multipurpose use, specifically, for supporting and shaping the pack and for use as a sleeping cot.

BACKGROUND OF THE INVENTION

The art is rich in proposals for backpack flames adapted to dual uses such as supporting a backpack and also serving as a stool, chair, stretcher, or bed. While the major focus of the art has been the multiple use characteristic, there has been little advancement distinguished for the materials used in the frame's construction or in the simplicity of design which would aid the practical use of such a dual purpose pack frame.

Despite continuous development of multi-use frame designs, there is still no design contemplating a cot use that has enjoyed substantial success in the market place. One of the principle reasons for this lack of commercial acceptance is that previous inventions are designed around age old technology using tubular aluminum piping commensurate with recreational chairs and recliners with the consequent result of the frame manifesting a bulk and weight exceeding that for practical use in backpacking or military maneuvering. For example, U.S. Pat. No. 3,828,992 entitled FOLDING COT PACK by J. Cerchione, discloses in its main embodiment the use of tubular metal. Moreover, the design cannot be folded in a totally flat compact arrangement. Thus, the design inherently causes the center of balance of the tubular metal frame to rest considerably rearward to that of the wearer's center of gravity. Additionally, the design does not allow ready access to the pack contents while being worn on the hiker's back.

Although the prior art describes convertible pack frames that are essentially flat and designed such that the bulk of the frame's weight rests in close proximity to the wears back, such designs do not address practicability of use for several reasons. For instance, U.S. Pat. No. 4,947,498 entitled PORTABLE COLLAPSIBLE BED by L. Van Boxtel, describes a convertible frame that can be unfolded from a flat compact arrangement made of two sections. The main practical problem with such a design is that in order for the two sections, when in the unfolded position, to provide a length necessary for a man of average height to lay upon, each section would necessarily be about 36 inches in length. Thus, when wearing the frame on the back, taking into consideration the use of a supporting waist belt, the top of the pack and frame would extend substantially above the wears head causing the center of balance to be considerably raised and necessarily create a top heavy arrangement of the carried weight. Moreover, since a main object of the present invention is use for military infantry, a pack frame of such dimensions and arrangement is unacceptable.

In U.S. Pat. No. 4,538,750 entitled CONVERTIBLE BED AND PACK FRAME by K. Hanna, a compact frame is also described which is designed to rest close to the wearer's back. However, the described frame is a multi-component system and must be assembled from separate detachable parts each time the frame is converted to the cot configuration. Although the invention has relatively few separate components, the fact of separable components and the necessity of assembly is not optimal for use under rugged conditions. Concerning convertible pack frames that have multiple separable parts, U.S. Pat. No. 3,620,428 entitled CONVERTIBLE BACKPACK AND COT APPARATUS by J. Silverthone, is exemplary. The Silverthorne invention is a pack frame which is compact and designed to rest in close proximity of the wearer's center of gravity. However, the design is such that it has no less than nine separate parts of various shapes and sizes which must be dismantled during conversion between pack frame and cot configurations.

Still other designs, though requiring fewer parts nonetheless required reconfiguration of separable parts or are unstable as a sleeping platform. For example, in U.S. Pat. No. 2,973,888 entitled CONVERTIBLE CAMP COTS by H. Beardsley, some of the frame legs must be removed and repositioned while the length of the cot is expandable by use of a separate optional section. In U.S. Pat. No. 4,511,071 entitled COMBINATION BACKPACK FRAME AND COT by R. Curran, a frame is described in which both ends of the frame are slidably expandable frown a central section. Only the central section provides vertical support. Thus any weight, such as from the shifting of body weight, on the outer unsupported sections would cause the cot to topple to one side.

Consistent with tile above, there can be seen a need in tile art for new multipurpose pack frames, especially for frames convertible to a sleeping platform. Ideally, since the user of a backpack is normally in environments of unpredictable terrain and weather conditions, and is tested with extremes of physical demand, the multiple purpose of such pack frames should be understood to include frames having the capacity to effectively be put to practical use under rugged conditions, thus enabling the user to realize respite from his physical exertion in relative comfort. Such frames should specifically consider the materials to be used for construction as well as a design that allows the frame to be easily converted between uses without requiring separation of component parts.

Desirably, such a frame would facilitate the shaping and support of the pack material itself, be constructed of lightweight material, be compact not only in size of structural components but also in its folding arrangment, allow for minimum of effort in converting from folded to unfolded arrangement, allow for a center of gravity in close proximity to that of the wearer's spinal column, allow stability during use as a sleeping platform, avoid separable elements, and be cost effective to the extent that it would allow use both by recreational and military packers.

The present invention specifically addresses problems in the technology associated with backpack frames designed for multiple purposes. Typical, multipurpose designs have commonly used solid wood or hollow tubular aluminum alloy metal to form the frame's rigid structure. It is an object of the current invention to incorporate the use of carbon fiber and/or metalo-ceramic, hard plastic, and nylon materials instead of tubular aluminum and canvas. Regarding materials, a further object of the invention is to provide a method by which the structural components may be constructed. For instance, hard plastic or carbon fiber may be molded into component parts which can in turn be assembled to form the rigid side supports that support the sleeping platform material.

Additionally, the present invention addresses the issue of a need for multipurpose frames to avoid complex multi-component designs such as those in the prior art that required the user to carry out numerous and sometimes complex manipulations of frame components in order to convert the frame between uses. It is an object of the invention to provide a pack frame that does not require manipulation of separable components. The main embodiment of the current invention includes a design comprised of a foldable structure with three structural members, a head, middle, and leg section, which utilize a novel hinge arrangement allowing the structure to realize a near flat profile when in a folded configuration. Moreover, it is an additional object of the invention to provide a simple locking means in conjunction with the novel hinge arrangement to rigidify the overall structure while in either folded or unfolded configurations.

A preferred embodiment of the invention contemplates that when the frame is folded, the three structural members or sleeping platform sections are nearly completely flat in relation to one another. This aspect of the invention allows the wearer to maintain a center of gravity in close proximity to his natural gravitational center. Additionally, the folded frame allows for a minimum vertical length with respect to the length of the wearer's torso. The size of the overall dimensions of the frame's components can be adjusted according to the height and width of the wearer in that a frame can be built to accommodate people of various heights and shoulder widths. For instance, for a person six feet in height, the length of the head section is contemplated to be about two feet three inches while the middle and leg sections would be about two feet one inch and two feet two inches respectively. These measurements would give rise to a cot length approximately six feet two inches when the frame is unfolded forming the sleeping platform configuration. The overall loss of approximately four inches to the total length of the three sections taken together is due to overlap of the sections by about one inch of each section at the hinge assemblies located between the head and middle and the middle and leg sections.

Concerning military use, recent advancements in high technology warfare are making special demands on infantry of the day. Specifically, the use of infrared detection equipment has led to the desirability of reducing the infrared heat signal emanated by the individual soldier. It is well known that a living body lying in one location will transmit heat to the immediate environment and leave a strong heat or IR signal which can be detected long after the body heat source has vacated the area. Therefore it is an object of the invention for the use of an easily transportable sleeping cot to eliminate latent body heat markers from transferring to the surrounding soil and fauna which could expose the bedding location of infantry to IR detection equipped enemy aircraft. Thus, the vertical supports which support and raise the sleeping platform from the ground are intended to have a length from top to bottom of about 12 to 14 inches.

It is a further object of the invention to provide a sleeping platform made of a material with a reasonable degree of resiliency to provide a springy or cushion aspect to the sleeping platform and thereby enhance comfort. Materials contemplated can include nylon, rubber, and neoprene. Additionally, it is also contemplated that the frame be so constructed as to provide an easy and single means by which the bedding material can be removed and replaced.

Yet, another object of the invention is to provide a frame that actively engages the material of the pack itself to provide support and shape to the forward facing side, left and right sides, and bottom of the pack material.

SUMMARY OF THE INVENTION

According to the present invention, a novel backpack frame is provided which accommodates shaping and supporting a backpack as well as a cot structure able to support the weight of a human. In the preferred embodiments, a frame is provided which is formed of composite materials such as carbon fiber and plastic or ceramic. The frame is generally symmetrical along a central axis and is constructed along the axis in three structural members; a head, middle, and leg section. The three sections are connected end to end with one another. Each section includes a means by which material is attached and supported for use as a sleeping platform. The distal or outer portions of the head and leg sections and interior or proximal portion of the head section include rigid projections positioned generally perpendicular to the plane of the length of the three connected sections and pointing parallel and in the same direction in relation to one another. These rigid projections point parallel and in the same direction whether the frame is in the folded or unfolded configuration. Moreover, these rigid projections act as vertical supports for the frame when it is configured as a sleeping platform and also directly support the pack material helping it to retain its desired shape. Additionally, the projections are generally triangular in shape and are substantially narrow at their base in relation to their height.

The interior or proximal ends of the head and leg sections are connected to either end of the middle section by a hinge assembly which includes a locking means such that when the three frame sections are arranged in either the folded or unfolded configuration the structure can be made rigid and unable to open or collapse. The invention also contemplates use of a spring plate in the hinge assembly which will allow the locking means to be engaged or disengaged such that the frame sections may be either locked into position or rotated in relation to one another between the folded and unfolded configurations.

The design of the frame contemplates that the leg section be narrower in width than the head and middle sections. In the folded configuration, the leg section and its sleeping platform material are also in closest proximity to the wearer. Because of this configuration, the leg section with its cot material acts as back support for the wearer of the frame. Consistent with this design, the middle and distal end of the leg section's cot material is provided with padding which is intended to add support and comfort to the mid and lower back of the wearer.

A further embodiment of the invention includes the use of shoulder straps and a waist belt, both of which are attached to the frame. The waist belt is connected to the frame at the distal portion of the leg section. The shoulder strap is connected to the frame at the head section and cross member at the distal portion of the head section.

BRIEF DESCRIPTION OF DRAWINGS

Numerous aspects and advantages of the invention will be apparent upon consideration of the following detailed description of preferred embodiments. The drawings depict various structural components in a rectangular wire frame motif. Presentation of structure in rectangular wire frame format is done primarily for simplicity sake. It is to be understood that the invention contemplates the use of curved surfaces for much of the tubular components as depicted in cross section drawings of FIGS. 5, 14, and 14*a*.

FIG. 2 is a perspective view looking from the right front of the backpack frame with the frame shown in a partially opened configuration.

FIG. 3 is a perspective view of the frame shown in the unfolded position.

FIG. 6 is a fragmentary perspective view showing the nature of the head section's sleeping platform material's engagement with a slot in a side support structure.

FIG. 7 is a fragmentary perspective view of the distal end of the leg section sleeping platform material and padding attached thereto. The figure includes a close-up (7*a*) taken along line 7*a*—7*a* looking at the end of the sleeping platform material and showing the material covering a solid circular cord.

FIG. 8 is an exploded perspective view showing the head section of the frame and a possible pack design both showing means for attaching the pack to the frame.

FIG. 8*a* is a rear view of the backpack attached to the frame.

FIG. 10 is a fragmentary view showing the relative dimensions of the triangular vertical supports and the cross member support of the head section. The figure also denotes the placement of screws for attaching the cross member to the vertical supports and for attaching the vertical supports to the side supports of the head section.

FIG. 10 a is a fractional view showing the vertical supports and cross member of the distal end of the leg section taken along line 10*a*—10*a* of FIG. 5.

FIG. 14 is a partial perspective exploded view of side support 11 showing internal construction of the side support.

FIG. 14*a* is a cross sectional view of side support 11 taken along line 14*a*—14*a* of FIG. 14 showing internal structural components of the side support.

DETAILED DESCRIPTION OF THE PREFERRED EMBODIMENTS

Figure 1:
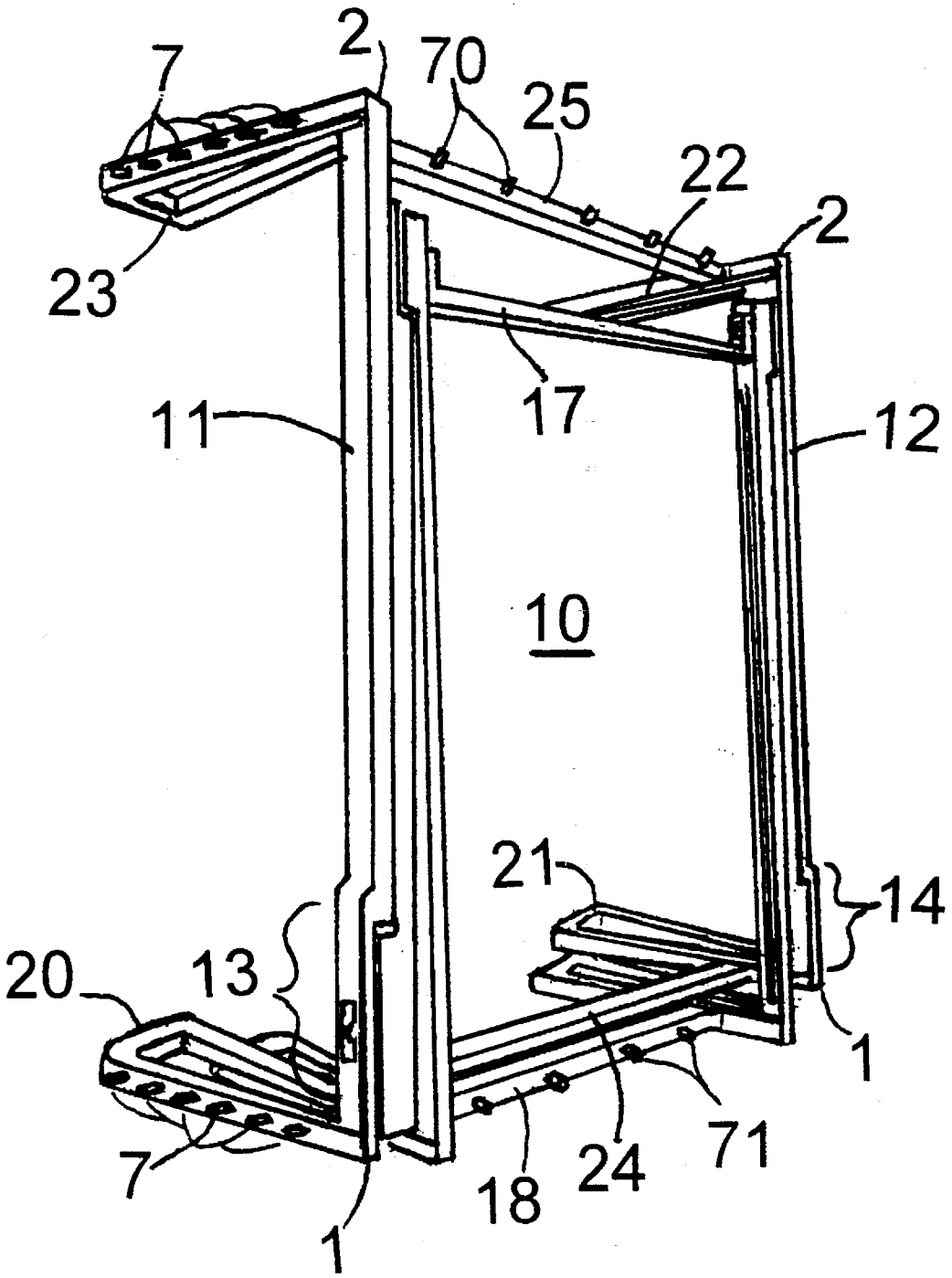
FIG. 1 is a perspective view of the combination backpack frame of this invention shown in its folded configuration looking towards the left front of the frame.

The convertible backpack frame of the present invention includes a frame generally designated 10 (FIG. 1) which is depicted in a folded configuration. The frame 10 is comprised of three sleeping platform structural members including a rigid head section H (FIG. 3), a rigid middle section M (FIG. 3), and a rigid leg section L (FIG. 3). Each of the three sections has a proximal and a distal end. For the head section H, the proximal end 1 is essentially the bottom end of the backpack frame in the folded configuration while the distal end 2 is the top of the backpack frame. In other words, the proximal end 1 is that end of the head section H which is connected by hinge assemblies 13 and 14 to the middle section M. The head section H is comprised of elements including two side supports (or rails) 11 and 12 which are coaxially arranged and parallel to one another, vertical sleeping platform supports 20, 21, 22, and 23, and cross member supports 24 and 25 (FIG. 3).

Side supports 11 and 12 are generally straight shafts which deviate laterally a short distance from their respective proximal ends 1. From the lateral deviation, the side supports 11 and 12 continue along a path that is parallel to the rest of the length of the shaft towards their respective proximal ends 1. The areas along the length of the laterally deviated lengths of side supports 11 and 12 comprise the area of the hinge assemblies 13 and 14.

Supports 11 and 12 are connected at their respective proximal and distal ends 1 and 2 to vertical sleeping platform supports 20, 21, 22, and 23. These vertical supports are generally triangular in shape with a foot or base that is shorter than the length or height of the triangle. The vertical supports are connected via screws 39 to side supports 11 and 12 at the apex or top of the triangle shape of the vertical supports utilizing slot 9 (FIG. 10) in the apex of the vertical triangular support. The vertical supports 20, 21, 22, and 23 of the head section H also have a multiplicity of snap pins 7 (FIGS. 8 and 10) which support the material of the pack.

Cross member supports 24 and 25 which lie perpendicular to side supports 11 and 12 are connected to vertical sleeping platform supports 20 and 21, or 22 and 23 by screws 38 (FIG. 10). The location of the connection between cross member supports 24 and 25 to their respective vertical supports 20, 21, 22, and 23 can be seen in FIG. 10 which is representative for vertical support and cross member connections at both the proximal 1 and distal 2 ends of head section H. It is to be understood that cross member support 24 is slightly longer in its length than cross member 25 due to the fact that the side supports 11 and 12 are farther apart from one another at the proximal end 1 of the head section H than at the distal end 2. Cross member supports 24 and 25 also have a multiplicity of snap pins 8 (FIG. 8 and 10) for attachment of the pack material. Cross member 25 contains a multiplicity of additional snap pins 70 (FIGS. 1, 2, and 3) on its forward facing side to accommodate the head section distal end of the cot material.

Figure 5:
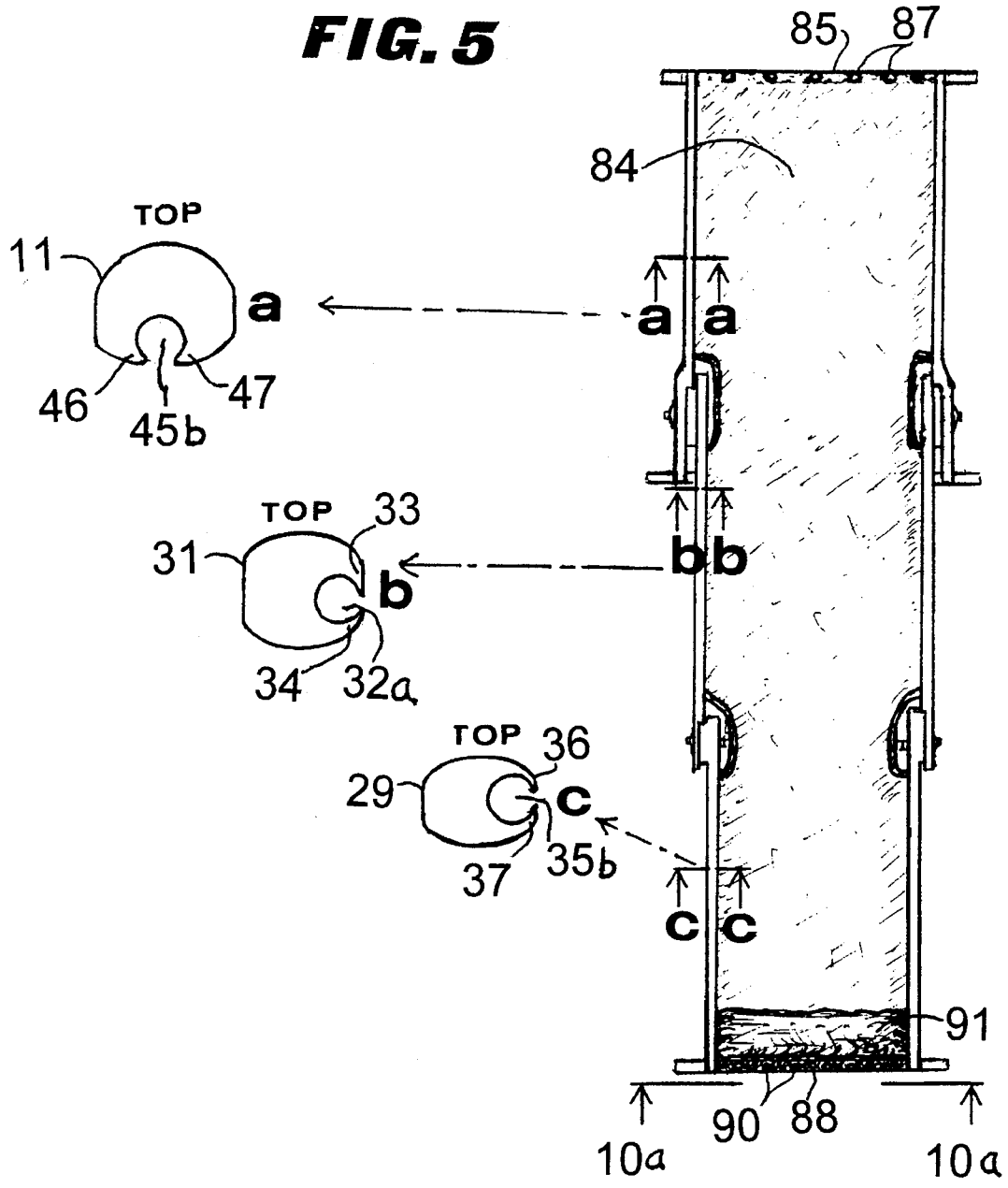
FIG. 5 is a top view of the pack frame with its sleeping platform material and shown in the unfolded configuration. The figure includes cross sectional views of the frame side support structure for the head, middle, and leg sections. Cross section (a) is taken along line a—a, cross section (b) is taken along line b—b, and cross section (c) is taken along line c—c.

It is contemplated that the head section H has three main functions which are to support a sleeping platform material, to support a backpack material, and to support shoulder straps for carrying the complete frame and pack. The support of the pack material is accomplished utilizing the multiplicity of snap pins 7 and 8 on vertical supports 20, 21, 22, and 23 and cross members 24 and 25 respectively. The snap pins 7 and 8 hook through their respective snap buckles 60 which are sewn into the fabric of material flaps 61 of the upper and lower sides and front of the pack (FIGS. 8 and 8*a*). To support the sleeping platform material, side supports 11 and 12 respectively have clefts 45*b* and 45*a* (FIG. 8) on the rearward 53 (FIG. 9) or bottom facing side of the side supports. Since side supports 11 and 12 are mirror images of one another, it is to be understood that cleft 45*b* is identical to 45*a*. Both 45*a* and 45*b* extend along the rearward or bottom length of their respective side support 11 and 12 between the hinge assemblies 13 and 14 and the distal end 2. FIG. 5 shows a cross section (a) of side support 11 taken along line a—a. Since clefts 45*a* and 45*b* are identical, only 45*b* is described. Cleft 45*b* is defined by cleft lips 46 and 47. The clefts allow the passage of cot material along the length of the cleft. The cleft lips of both 45*a* and 45*b* are spread apart at their respective proximal ends 43 (FIG. 9) to allow entrance of the cot material into the cleft. The distal end 44 (FIG. 9) of the clefts terminate without expansion of the cleft lips. The positioning of the clefts at the rearward or bottom 53 side of side supports 11 and 12 is critical for the fact that such placement allows the side supports 30 and 31 of the middle section M and side supports 28 and 29 of the leg section L to be collapsed in a nearly flat configuration in relation to one another and the head section H.

It is contemplated that attachment of the shoulder straps 80 (FIG. 13) to side supports 11 and 12 will be located generally between the distal half of the side supports and the hinge assemblies 13 and 14. Additional shoulder support straps 81 are connected to the central region of cross member 25. The shoulder strap component is further contemplated to include at least one cross chest buckle strap 82 connecting the left and right shoulder straps so as to aid the shoulder straps to ride properly on the wearer's shoulders.

Figure 9:
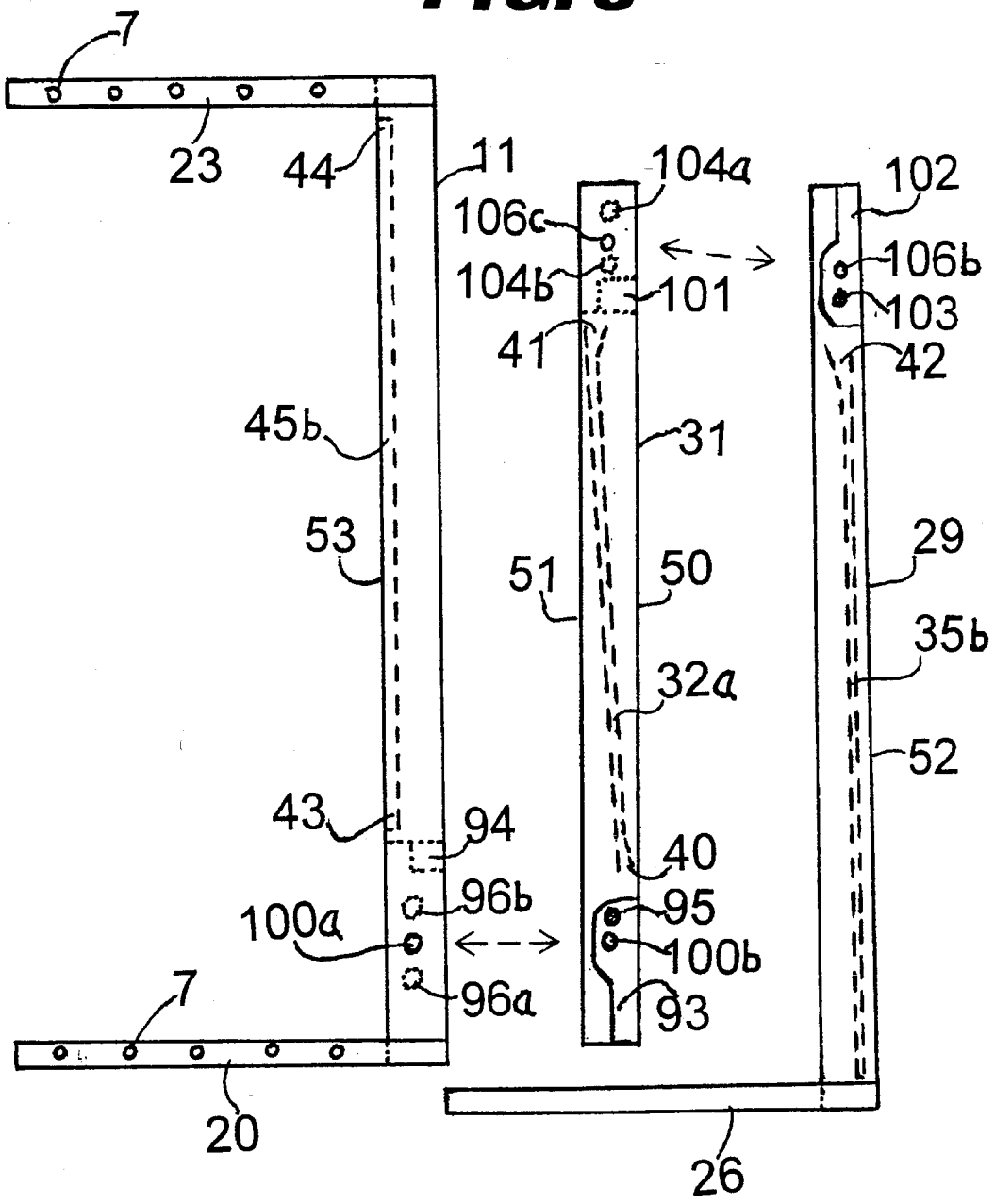
FIG. 9 is an exploded side view of the frame showing details of the frame's side support components.

For the middle section M, the proximal end 3 (FIG. 2) is that end which is connected to the head section H by hinge assemblies 13 and 14. The distal end 4 of the middle section M is that end which is connected to the leg section L via hinge assemblies 15 and 16 (FIG. 3). The middle section M consists of side supports (or poles) 30 and 31. Side supports 30 and 31 lie in a coaxial position and are parallel to one another. Side supports 30 and 31 are essentially mirror images of one another. The main function of the middle section M is to support a sleeping platform material. In order to accomplish this function, the supports 30 and 31 have clefts 32*b* (FIG. 3) and 32*a* (FIG. 2) respectively. FIG. 5 shows cross section (b) taken along line b—b of side support 31. Cross section (b) shows cleft 32*a* is defined by cleft lips 33 and 34. Cleft 32*b* of side support 30 and its defining cleft lips (not shown) is a mirror image of cleft 32*a*. Clefts 32*a* and 32*b* extend generally along the length of side supports 30 and 31 between hinge assemblies 13, 14. 15, and 16. Clefts 32*a* and 32*b* are positioned to have their openings facing one another and to lie in the same plane along the entirety of their respective lengths. Importantly, for the middle section M, the clefts 32*a* and 32*b* do not run parallel to the length of the side supports 30 and 31 but are purposely designed to be skewed such that they begin at their respective proximal ends 40 (FIG. 9) closer to a rearward or bottom facing side 50 (FIG. 9) of the side support, as determined by the position of the side supports in the sleeping cot configuration. Consequently, clefts 32*a* and 32*b* terminate at their respective distal ends 41 closer to a forward or top facing side 51 of the side support. FIG. 9 shows a detail of this arrangement looking from the side of the side support 31. FIGS. 2 and 3 also show the skewed arrangement of clefts 32*a* and 32*b*. The skewed arrangement is critical for the fact that such arrangement allows the side supports 28 and 29 (FIG. 3) of leg section L to collapse in a nearly flat arrangement with respect to the middle section M when the sleeping cot material is in place. Moreover, the cleft lips 33 and 34 of side support 31 are spread apart at both the proximal and distal ends 40 and 41 of cleft 32*a*. The same is true for cleft 32*b*. This allows the cot material to be admitted into the cavity of the cleft from either end of the middle section M.

For the leg section L, the proximal end 5 is that end which is connected to the middle section via hinge assemblies 15 and 16. The distal end 6 is that end which is connected to vertical sleeping platform supports 26 and 27 (FIG. 2). The leg section L is comprised of side supports (or tubes) 28 and 29, vertical supports 26 and 27, and cross member supports 17 and 18 (FIG. 3). The leg section L has three main functions including support for cot material, support for the upper and lower portions of the wearer's back, and support for a waist belt. In order to accomplish support for the cot material, side supports 28 and 29 have clefts 35*a* and 35*b* respectively. The clefts are defined by cleft lips. FIG. 5 shows cross section (C) taken along line C—C of side support 29 showing cleft 35*b* defined by cleft lips 36 and 37. The cleft 35*a* of side support 28 and its cleft lips (not shown) are a mirror image of 35*b*, 36 and 37. Clefts 35*a* and 35*b* of side supports 28 and 29 extend along the length of the side supports 28 and 29 between hinge assemblies 15 and 16 and vertical supports 26 and 27. The proximal end 42 of the clefts 35*a* and 35*b* (FIG. 9 shows support 29 and cleft 35*b*) are spread apart to accommodate the entrance into the cleft of cot material. The distal end of the clefts 35*a* and 35*b* terminate without spreading of the cleft lips. The cleft arrangement of side supports 28 and 29 are such that the clefts are positioned closer to the forward facing side 52 (FIG. 9) of the supports and such that the clefts run parallel to the length of the side supports. This forward positioning of the clefts will allow the cot material to rest closer to the wearer's back giving necessary support for padding which is attached to the cot material as described below.

Side supports 28 and 29 are connected to vertical supports 26 and 27 at their respective distal ends 6. The vertical supports 26 and 27 are connected together via cross member support 18 (FIGS. 3 and 10*a*). Vertical supports 26 and 27 are identical to the vertical supports of the head section H in their over all shape and dimensions except that vertical supports 26 and 27 do not include any snap pins. Also, the cross member 18 is attached to supports 26 and 27 in an identical manner as the cross members of the head section H. Cross member 18 additionally includes a multiplicity of snap pins 71 (FIGS. 1 and 10*a*) along its forward or top facing side to accommodate attachment of the cot material at the distal end 6 of the leg section L.

Figure 4:
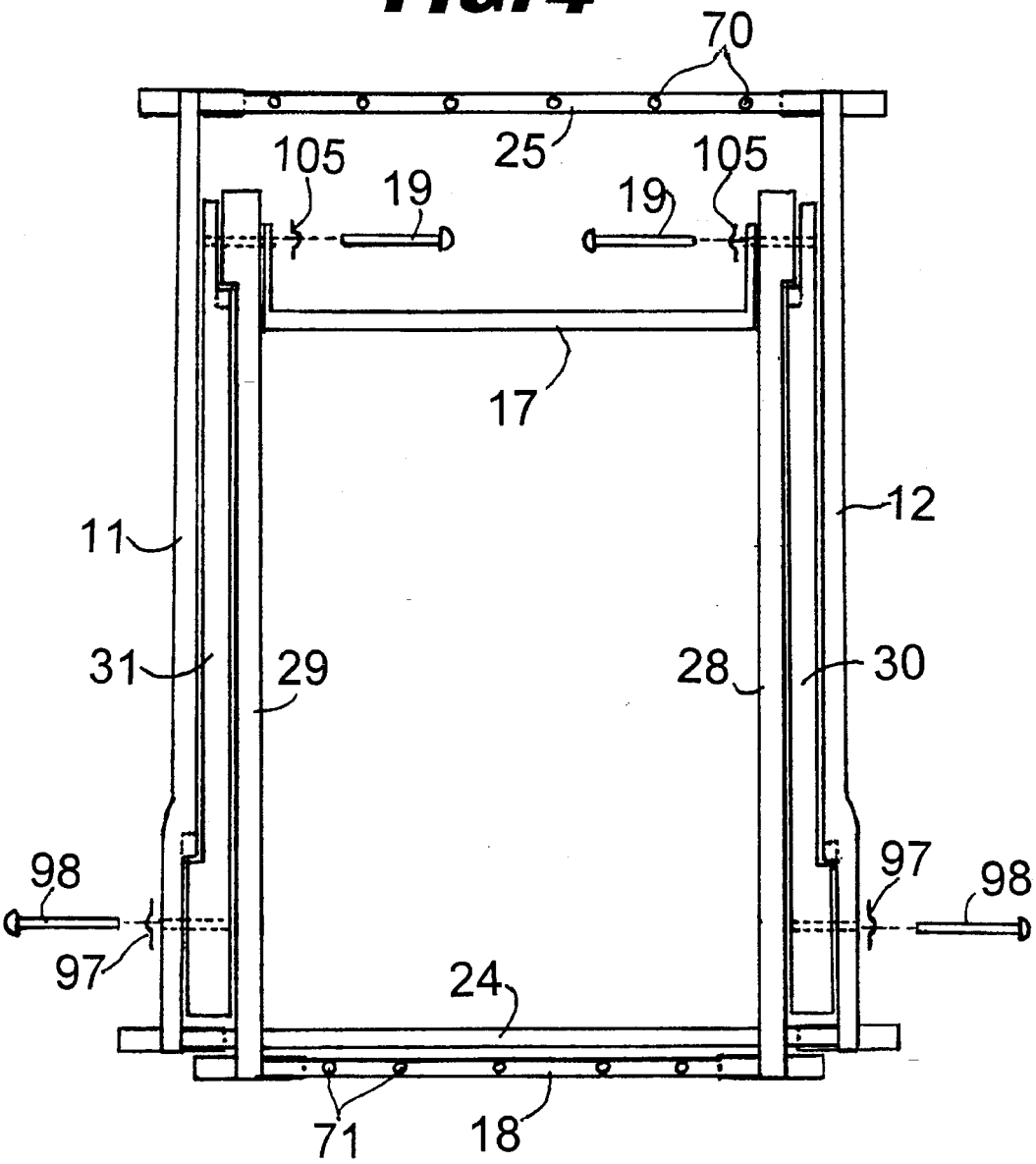
FIG. 4 is a front view of the frame shown in the folded position. The figure also shows in an exploded view the hinge pins and spring plates for each hinge assembly.
Figure 12:
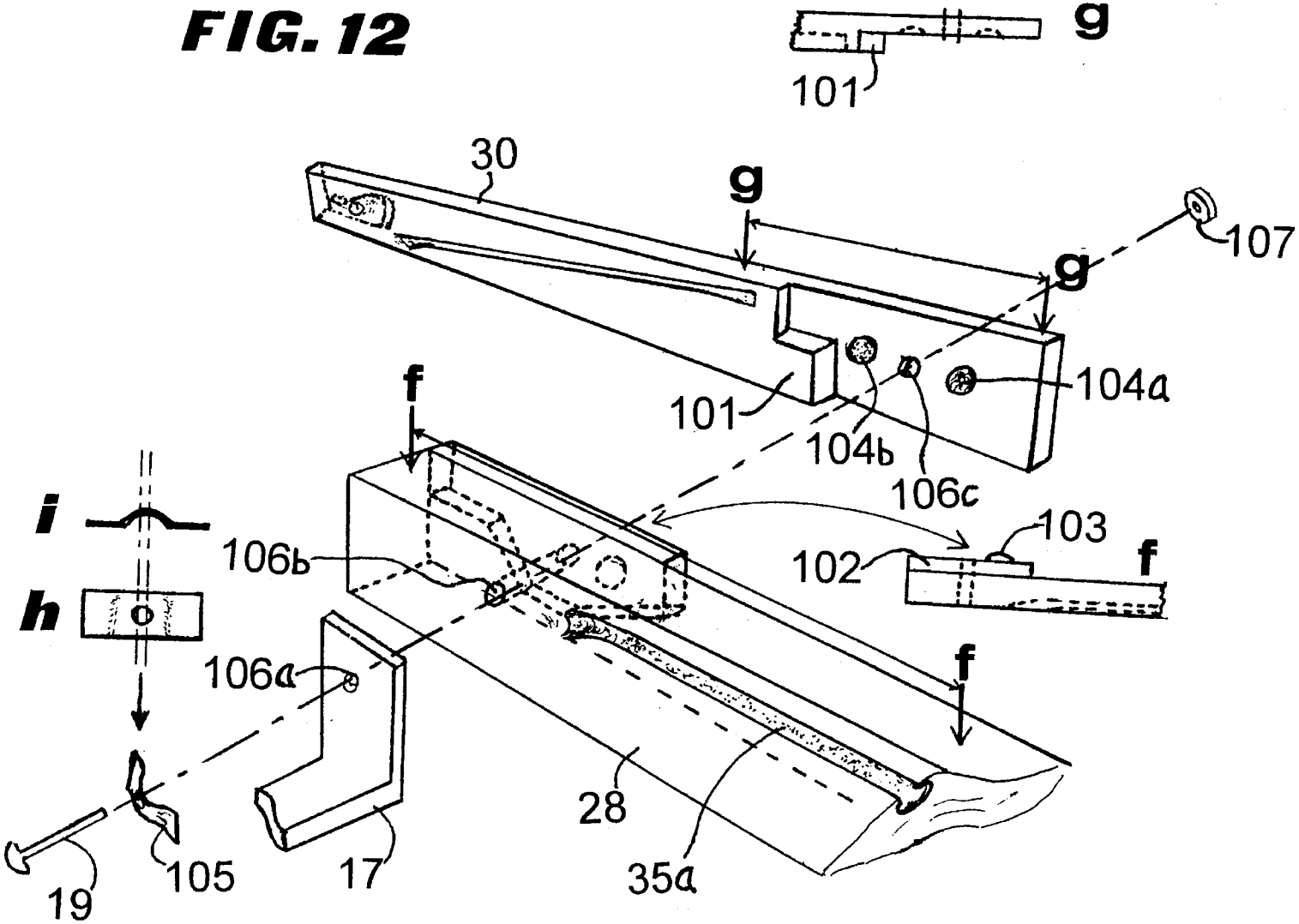
FIG. 12 is an exploded fragmentary view showing the hinge assembly of one side of the middle section in conjunction with the leg section. The figure also depicts fragmentary top views of the middle and leg section side support members taken along lines f—f and g—g about the hinge assembly. The figure further shows both a top (h) and a side (i) view of the spring plate.
Figure 13:
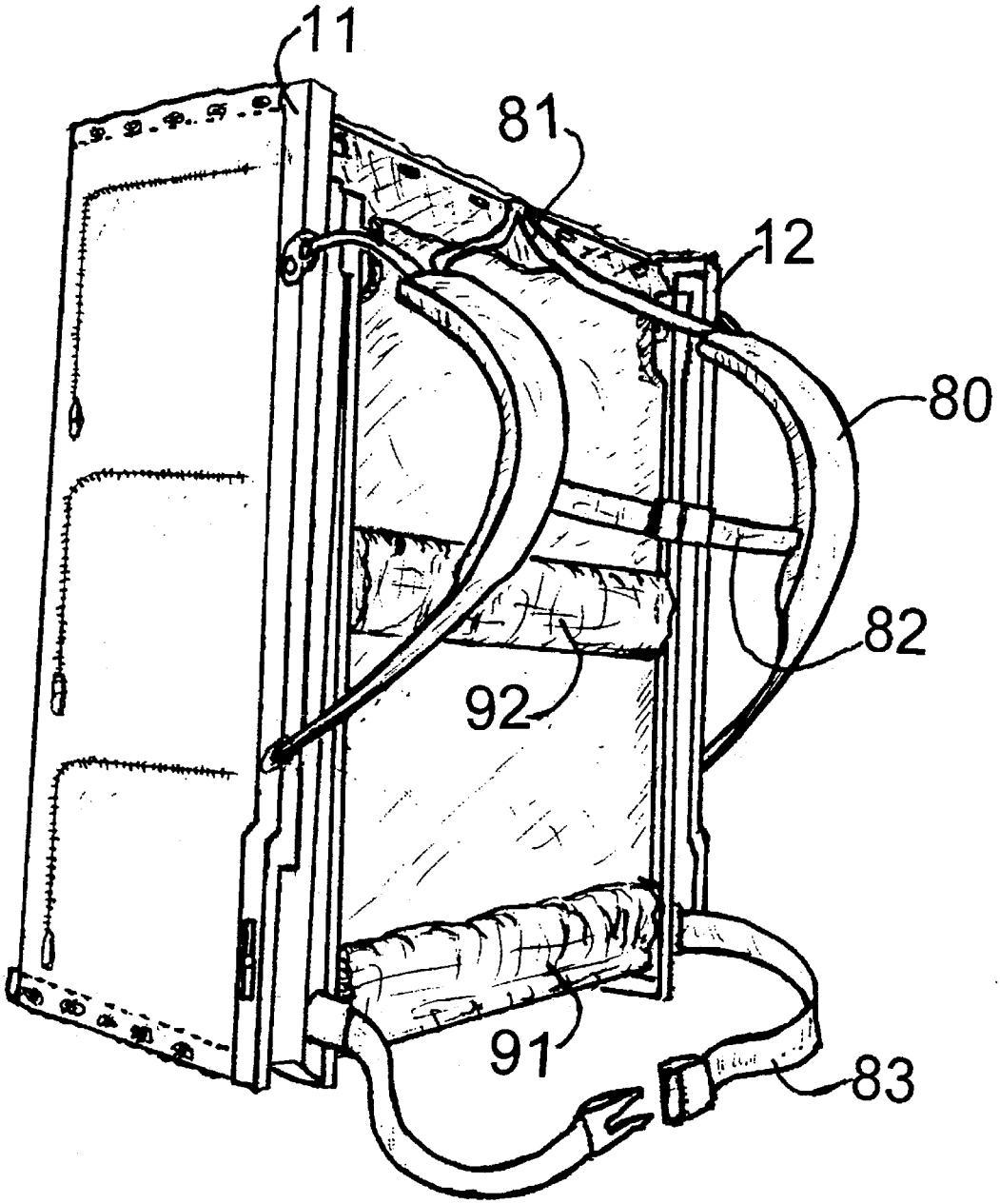
FIG. 13 is a perspective view looking from the left front of the complete backpack and frame showing an arrangement of the shoulder and waist straps.

Cross member support 17 is located at the proximal end 5 of the leg section L and is attached to side supports 28 and 29 by hinge pins 19 (FIGS. 4 and 12). The function of cross member 17 is to provide lateral support to sections M and L so that the weight of a person lying on the sleeping material will not cause the frame to collapse inward at the juncture of hinge assemblies 15 and 16. At the distal end 6 of the leg section L is attached waist belt 83 (FIG. 13).

FIGS. 5, 6, and 7 show aspects of the sleeping platform material attachment. FIG. 5 shows the cot with material in the sleeping platform configuration. The cot material 84 is connected to the head section H through clefts 45*a* and 45*b* of side supports 12 and 11 respectively. The head end 85 of the cot material includes along its length edge flap 86 (FIG. 6) which contains a multiplicity of snap buckles 87 which attach to matching snap pins 70 on cross member 25. FIG. 6 depicts cot material 84 as being slid along cleft 45*b* of side support 11. FIG. 7 depicts the foot end 88 of cot material 84 which includes edge flap 89 along the length of the foot end 88. Edge flap 89 contains a multiplicity of snap buckles 90 which attach to matching snap pins 71 on cross member 18. The foot end 88 region of the cot material 84 also includes lower back support pad 91. It should be remembered that other back support pads may also be included such as that shown for the mid-region of the back 92 in FIG. 13. FIG. 7 includes cross section 7*a* which shows a close up cross section of the cot material 84 that is designed to enter the clefts of the side support tubing. Cot material 84 is wrapped around flexible cord 95 and sewn back upon itself. Flexible cord 95 can be made of any number of common cord materials. The diameter of the cord with the cot material wrapped around it is sized to slide into the clefts of the side supports such that there is very little clearance inside the cleft or between the cleft opening, cot material, and cleft lips. This will allow tension to be place on the cot material, such as from a person laying upon it, without tile cot material detaching from the side support clefts.

Figure 11:
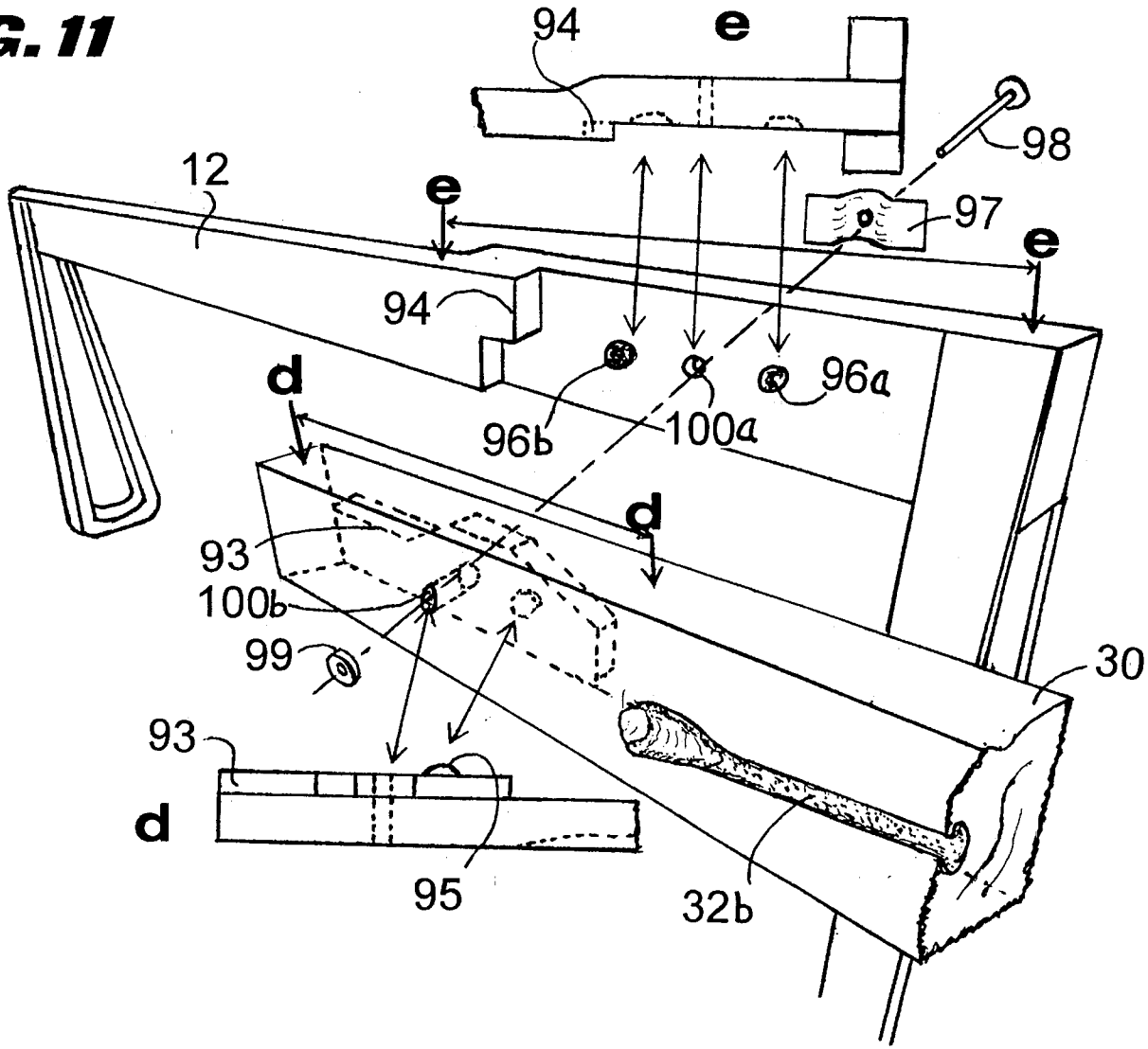
FIG. 11 is an exploded fragmentary view showing the hinge assembly of one side of the head section in conjunction with the middle section. The figure also shows fragmentary top views of the head and middle section side support members taken along lines d—d and e—e about the hinge assembly.

Hinge assemblies 13, 14, 15, and 16 operate in the same manner in relation to one another. Hinge assemblies 13 and 14 are mirror images of one another while hinge assemblies 15 and 16 are mirror images of one another. FIG. 11 depicts hinge assembly 14 in an exploded format. The design of each of the hinges allows the side supports extending from either side of the hinge assemblies to pivot about an axis from a collapsed position, in which the side supports are parallel and lying adjacent to one another, to an open position along an arc 180 degrees from the closed position at which the side supports are parallel and extend directly away from one another. In the example of FIG. 11, side supports 12 and 30 are unable to pivot greater than 180 degrees due to the mating of a catch plate 93 on side support 30 and a stop block 94 on the adjacent side support 12. The side supports are further kept from pivoting in either direction by the automatic engagement of a locking pin 95, which is shown in the cross section (d) along line d—d, with locking pin cups 96*a* and 96*b* located in the hinge assembly portion of side support 12. Locking pin 95 is mounted to catch plate 93. Cross section (e) Taken along line e—e shows the location and arrangement of the cups 96*a* and 96*b*. Locking pin cup 96*a* engages locking pin 95 when the side supports of the head H and middle M sections are pivoted to the open cot configuration. Locking pin cup 96*b* engages locking pin 95 when the head H and middle M sections are pivoted to the closed or pack frame configuration. The engagement of the locking pin into the locking pin cups is caused by lateral tension created from a spring plate 97 which is held in place by the hinge pin 98. Hinge pin 98 in turn acts as the axis about which the side supports of sections H and M pivot. The hinge pin 98 is inserted through aperture 100*a* of side support 12 and aperture 100*b* of side support 30 and is held in place by keeper 99. A critical element in the hinge assembly arrangement is the amount of lateral tolerance allowed by the spring plate 97. The spring plate is made of a metal with a memory and the tolerance allowed is just enough to disengage the locking pin 95 from the lock pin cups 96*a* and 96*b* without allowing side support 30 to move laterally enough to disengage the mating of catch plate 93 from stop block 94 of side support 12. Additionally, spring plate 97 provides enough tension to require substantial lateral force, such as by pressing the proximal regions 3 of side supports 30 and 31 toward one another, to disengage the locking pin and locking pin cups.

FIG. 12 shows hinge assembly 16 in an exploded format. Hinge assembly 16 is a mirror image of hinge assembly 15. As determinable by FIG. 12, side support 30 is able to pivot about an axis determined by hinge pin 19. The side supports may pivot about each other on an arc of 180 degrees from a closed arrangement in which the side supports 12 and 30 are lying adjacent to one another and almost parallel, to an open position in which the supports are parallel and extend 180 degrees away from one another. The side supports 12 and 30 are kept from pivoting greater than 180 degrees due to the mating of stop block 101 on side support 30 with catch plate 102 on side support 28. The side supports are further kept from pivoting greater than 180 degrees by the automatic engagement of locking pin 103 with lock pin cups 104*a* and 104*b*. Locking pin 103 is mounted to catch plate 102. Locking pin 103 is automatically engaged with the lock pin cups due to lateral tension created by spring plate 105 which is held in place by hinge pin 19. FIG. 12 shows a top view (h) and a side view (i) of the spring plate 105. Spring plate 105 is identical to spring plate 97. The tension created by spring plates 105 onto hinge assemblies 15 and 16 is the same as the tension created by spring plates 97 on hinge assemblies 13 and 14. For hinge assemblies 13 and 14, spring plates 97 are located on the outer facing sides of side supports 11 and 12. For hinge assemblies 15 and 16, spring plates 105 are located adjacent to cross support 17. Hinge pin 19 is kept in place through apertures 106*a*, 106*b* and 106*c* by hinge pin keeper 107.

Construction of tubular structures from composite materials such as carbon fiber, metals, plastics, and ceramics is generally known in the art. For the present invention the main structural components may be constructed from each of these materials. The vertical sleeping platform supports can be made of molded hard plastics. The side supports and cross member supports can be made of carbon fiber or hard plastics. The tubing of the side supports and cross members can either be produced as a single unit by injection molding or from several components which are formed from molds then fitted together to create the complete side support or cross member. The screws, hinge pins, spring plate, locking pins and snap pins and buckles may be made of metal. FIG. 14 shows one example for side support construction. In this embodiment of the invention the proximal 1 and distal 2 ends of side support 11 are formed of solid material such as carbon fiber or hard plastic. The solid nature of the proximal and distal ends will allow strength for attachment of vertical support members and side supports connected via the hinge assembly. The tube section of side support 11 is a continuation of the material used for the proximal and distal ends but is molded to form component Y which is the bottom length of side support 11. Component Y provides strength to the cleft 45*b* because of its solid construction around the length of the cleft. Component Y also has projections a, b, c, d, and e (FIG. 14*a*) which run the length of component Y. Projections a and e make up the outer walls of the side support. Projections a, b, c, d, and e are designed to lock with projections f, g, h, and i of component X which is the top length of the side support. Components X and Y are designed to snap together as depicted in FIG. 14*a*. When connected together, components X and Y form a completed side support (in this case side support 11) which harbors considerable strength due to the I-beam structure realized by the mating of projections a through i. The same type of construction can be obtained for all of the side supports.

Although the embodiment described is a preferred embodiment, numerous modifications and variations of the invention as disclosed above are expected to occur to those of ordinary skill in the art and consequently only limitations which appear in the appended claims should be placed thereon.

I claim:

1. A convertible backpack frame comprising:

first, second, and third structural members, said first, second, and third structural members each having a proximal and a distal end, said first structural member being pivotally connected at its proximal end to the proximal end of said second structural member and said second structural member being pivotally connected at its distal end to the proximal end of said third structural member;

said first structural member having components including two spaced side support rails, a multiplicity of vertical support posts, and first and second cross member supports;

said side support rails of said first structural member being parallel and collaterally arranged on a plane in relation to one another as well as parallel and on opposite sides of a central axis running down the center of said first structural member from said distal to said proximal ends of said first structural member, said side support rails further extending the length of said first structural member such that one end of said side support rails is at said proximal end and the other end of said side support rails is at the distal end of said first structural member, said side support rails further having a cleft running along the length of one side of each rail for attaching a sleeping cot material;

one of said vertical support posts being connected to each end of each said side support rails such that said vertical support posts are attached to said side support rails at an angle perpendicular to the plane of said side support rails, said vertical support posts further being parallel to one another and facing the same direction in relation to their extension away from said side support rails to which they are attached, said vertical support posts further having a multiplicity of snap pins for attaching backpack material to said frame;

said first cross member support being connected between said vertical support posts that are attached to the proximal end of said side support rails of said first structural member, said first cross member support further having a multiplicity of snap pins for attaching backpack material to said frame, said second cross member support being connected between said vertical support posts that are attached to the distal end of said side support rails of said first structural member, said second cross member support further having a multiplicity of snap pins for attaching either a sleeping cot material or backpack material to said frame;

said second structural member having components including two spaced side support poles, said side support poles of said second structural member being parallel and collaterally arranged in relation to one another as well as parallel and on opposite sides of a central axis running down the center of said second structural member from said distal to said proximal end of said second structural member, said side support poles further extending the length of said second structural member such that one end of said side support poles is at said proximal end and the other end of said side support poles is at the distal end of said second structural member, said second structural member's side support poles further having a cleft running along the length of one side of each of said side support pole for attaching a sleeping cot material;

said third structural member having components including two spaced side support tubes, two vertical support posts, and first and second cross supports;

said side support tubes of said third structural member being parallel and collaterally arranged on a plane in relation to one another as well as parallel and on opposite sides of a central axis running down the center of said third structural member from said distal to said proximal end of said third structural member, said side support tubes further extending the length of said third structural member such that one end of said side support tubes is at said proximal end of said third structural member and the other end of said side support tubes is at the distal end of said third structural member, said third structural member's side support tubes further having a cleft running along the length of one side of each of said side support tubes for attaching a sleeping cot material;

one of said vertical support posts of said third structural member being connected to the distal end of each said side support tubes such that said vertical support posts are attached to said side support tubes at an angle perpendicular to the plane of said side support tubes, said vertical support posts further being parallel to one another and facing the same direction in relation to their extension away from said side support tubes to which they are attached;

said first cross support of said third structural member being connected between said vertical support posts which are attached to the distal end of said side support tubes, said first cross support of said third structural member having a multiplicity of snap pins for attaching a sleeping cot material to said frame, said second cross support being connected to said side support tubes at the proximal end of said side supports tubes.

2. A backpack frame according to claim 1 in which the first, second, and third structural members are pivotally connected by means of a first and second set of hinge assemblies, said first and second structural members being so connected by said first set consisting of two of said hinge assemblies such that one of said assemblies connects the proximal end of each of said side support rails of the first structural member to the proximal end of each of said side support poles of said second structural member, said second and third structural members being so connected by said second set consisting of two of said hinge assemblies such that one of said assemblies connects the distal end of each of said side support poles of the second structural member to the proximal end of each of said side support tubes of said third structural member;

each of said hinge assemblies including a hinge pin, a spring plate, a stop block, a catch plate, a lock pin, and lock pin cups;

said hinge pins of said first set of said hinge assemblies providing an axis about which the first and second structural members pivot in relation to one another, said hinge pins of said second set of said hinge assemblies providing an axis about which the second and third structural members pivot in relation to one another;

said hinge pins of each of said hinge assemblies of said first set connecting said first and second structural members holding in place a spring plate, a side support rail of said first structural member, a side support pole of said second structural member and a catch plate, said catch plate being permanently bonded to said side support pole, said catch plate further having located thereon said lock pin, said side support rail of said first structural member having located thereon said stop block and said lock pin cups;

said hinge pins of each of said hinge assemblies of said second set connecting said second and third structural members holding in place a spring plate, said second cross support of said third structural member, a side support tube of said third structural member, a catch plate, and a side support pole of said second structural member, said catch plate being permanently bonded to said side support tube, said catch plate further having located thereon said lock pin, said side support pole of said second structural member having located thereon said stop block and said lock pin cups.

3. A backpack frame according to claim 2 in which a sleeping cot material is held in place by memos of clefts running within said side support rails, poles, and tubes of said frame's structural members.

4. A backpack frame according to claim 3 in which backpack material is held to said frame by means of snap pins and snap buckles.

* * * * *